US008769738B2

(12) United States Patent
Horst et al.

(10) Patent No.: US 8,769,738 B2
(45) Date of Patent: Jul. 8, 2014

(54) BASSINET SET AND PLAYARD MODULE THEREOF

(75) Inventors: Andrew J. Horst, West Lawn, PA (US); Jonathan M. Pacella, Coatesville, PA (US)

(73) Assignee: Wonderland Nurserygoods Company Limited, Central (HK)

( * ) Notice: Subject to any disclaimer, the term of this patent is extended or adjusted under 35 U.S.C. 154(b) by 325 days.

(21) Appl. No.: 13/192,470

(22) Filed: Jul. 28, 2011

(65) Prior Publication Data

US 2012/0036633 A1 Feb. 16, 2012

Related U.S. Application Data

(60) Provisional application No. 61/401,310, filed on Aug. 11, 2010, provisional application No. 61/384,714, filed on Sep. 21, 2010.

(51) Int. Cl.
*A47D 13/02* (2006.01)
*A47D 13/06* (2006.01)

(52) U.S. Cl.
USPC ..... 5/93.2; 5/101; 5/93.1

(58) Field of Classification Search
USPC ..... 5/93.1, 93.2, 94, 101, 655
See application file for complete search history.

(56) References Cited

U.S. PATENT DOCUMENTS

| | | | |
|---|---|---|---|
| 2,560,945 | A | 7/1951 | Goldberger |
| 3,239,018 | A | 3/1966 | Mazursky |
| 3,279,549 | A | 10/1966 | Feinberg |
| 4,674,582 | A | 6/1987 | Kunz |
| 4,798,251 | A | 1/1989 | Maaz |
| 4,848,477 | A | 7/1989 | Oldendorf |
| 4,979,580 | A | 12/1990 | Lockery |
| 5,065,830 | A | 11/1991 | Stevenson |
| 5,319,817 | A | 6/1994 | Hay |
| 5,499,457 | A | 3/1996 | Weiler |
| 5,511,571 | A | 4/1996 | Adrezin |

(Continued)

FOREIGN PATENT DOCUMENTS

| | | | |
|---|---|---|---|
| CN | 2822388 | Y | 10/2006 |
| CN | 101297726 | A | 11/2008 |

(Continued)

OTHER PUBLICATIONS

Luebkeman et al., "What is a Moment?"(http://web.mit.edu/4.441/1_lectures/1_lecture5/1_lecture5.html), pp. 1-4, Apr. 2014.

(Continued)

*Primary Examiner* — Fredrick Conley
(74) *Attorney, Agent, or Firm* — Winston Hsu; Scott Margo

(57) ABSTRACT

A bassinet set is used for hanging on a playard. The bassinet set includes a bassinet and a placing device. The bassinet has at least one first angle adjusting sleeve formed on an inner wall of the bassinet. The placing device is removably disposed on the bassinet. The placing device includes a holding body and a tubular frame. The holding body is used for holding an infant. The tubular frame is disposed around the holding body. The tubular frame includes a first end portion and the second end portion. The second end portion is used for detachably connecting to the first end portion after the first end portion passes through the first angle adjusting sleeve, so as to make the holding body oblique to the bassinet.

20 Claims, 4 Drawing Sheets

(56) References Cited

U.S. PATENT DOCUMENTS

| | | | | |
|---|---|---|---|---|
| 6,256,896 | B1 | 7/2001 | Landauer | |
| 6,948,197 | B1 | 9/2005 | Chen | |
| 6,952,849 | B2 | 10/2005 | Pacella | |
| 7,847,202 | B2 | 12/2010 | Mueller | |
| 7,950,081 | B2 | 5/2011 | Chen | |
| 2004/0187212 | A1 | 9/2004 | Pacella | |
| 2006/0080776 | A1 | 4/2006 | Clapper | |
| 2006/0130237 | A1 | 6/2006 | Clapper | |
| 2006/0218725 | A1 | 10/2006 | Carpenter | |
| 2008/0271243 | A1* | 11/2008 | Burkholder et al. | 5/93.2 |
| 2009/0173549 | A1 | 7/2009 | Lev | |

FOREIGN PATENT DOCUMENTS

| | | | |
|---|---|---|---|
| CN | 201147077 | Y | 11/2008 |
| CN | 101366582 | A | 2/2009 |
| CN | 201361035 | Y | 12/2009 |

OTHER PUBLICATIONS

Archie Higdon et al., "Moment of a Force" from Engineering Mechanics: Statics and Dynamics, Prentice-Hall, Inc., cover page, contents and pp. 22-25, 1976.

* cited by examiner

BASSINET SET AND PLAYARD MODULE THEREOF

CROSS REFERENCE TO RELATED APPLICATIONS

This application claims the benefit of U.S. Provisional Application No. 61/401,310, which was filed on Aug. 11, 2010, and the benefit of U.S. Provisional Application No. 61/384,714, which was filed on Sep. 21, 2010, and is incorporated herein by reference.

BACKGROUND OF THE INVENTION

1. Field of the Invention

The present invention relates to a bassinet set and a playard module thereof, and more specifically, to a bassinet set capable of adjusting an angle of a placing device relative to a bassinet and a playard module thereof.

2. Description of the Prior Art

For meeting user needs, many additional accessories are disposed on a playard to increase convenience of the playard in use, such as assembly of a bassinet and an infant napper.

A conventional infant napper is a convenient and common tool for a caregiver to take care of an infant. The conventional infant napper is usually used for disposing on a bassinet hung on a playard to allow that the caregiver can place the infant thereon, so as to make the infant lie comfortably. However, the conventional infant napper does not have an angle adjusting function. Thus, if the caregiver wants to feed the infant on the infant napper directly, infant acid reflux or choking may occur easily since the infant lies flat on the infant napper. Although the said problem can be solved by additional disposal of an angle adjusting mechanism in the infant napper, the angle adjusting mechanism may cause the structural design of the infant napper to be too complicated and difficult to operate.

SUMMARY OF THE INVENTION

The present invention provides a bassinet set for hanging on a playard. The bassinet set includes a bassinet and a placing device. The bassinet has at least one first angle adjusting sleeve formed on an inner wall of the bassinet. The placing device is removably disposed on the bassinet. The placing device includes a holding body and a tubular frame. The holding body is used for holding an infant. The tubular frame is disposed around the holding body. The tubular frame includes a first end portion and a second end portion. The second end portion is used for detachably connecting to the first end portion after the first end portion passes through the first angle adjusting sleeve, so as to make the holding body oblique to the bassinet.

The present invention further provides a playard module including a playard and a bassinet set. The bassinet set is hung on the playard. The bassinet set includes a bassinet and a placing device. The bassinet has at least one first angle adjusting sleeve formed on an inner wall of the bassinet. The placing device is removably disposed on the bassinet. The placing device includes a holding body and a tubular frame. The holding body is used for holding an infant. The tubular frame is disposed around the holding body. The tubular frame includes a first end portion and a second end portion. The second end portion is used for detachably connecting to the first end portion after the first end portion passes through the first angle adjusting sleeve, so as to make the holding body oblique to the bassinet.

The present invention further provides a playard module including a playard and a placing device. The playard has at least one first angle adjusting sleeve formed on an inner wall of the playard. The placing device is removably disposed on the playard. The placing device includes a holding body and a tubular frame. The holding body is used for holding an infant. The tubular frame is disposed around the holding body. The tubular frame includes a first end portion and a second end portion. The second end portion is used for detachably connecting to the first end portion after the first end portion passes through the first angle adjusting sleeve, so as to make the placing device oblique to the playard.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
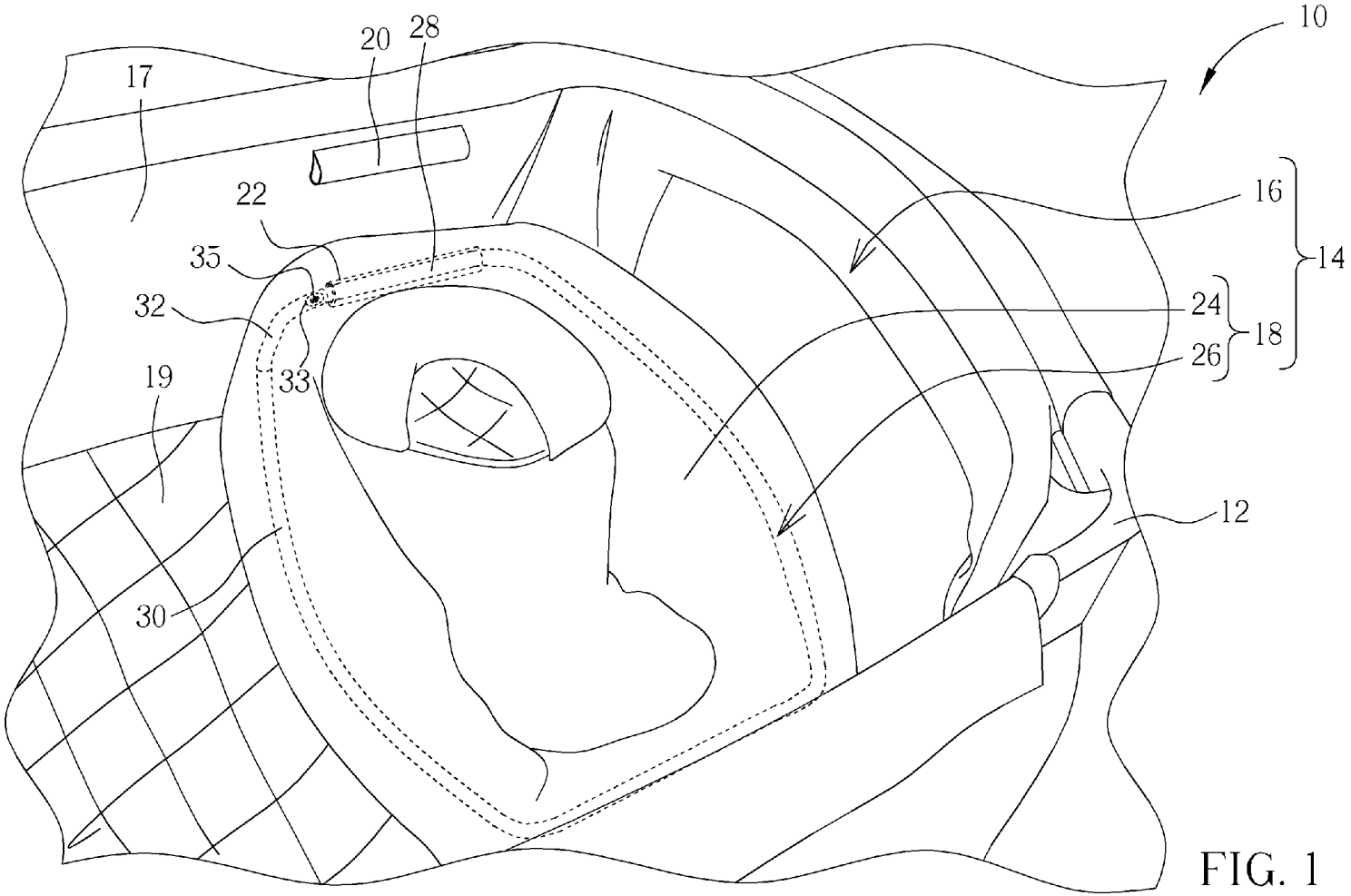
FIG. 1 is a partial diagram of a playard module according to an embodiment of the present invention.
Figure 2:
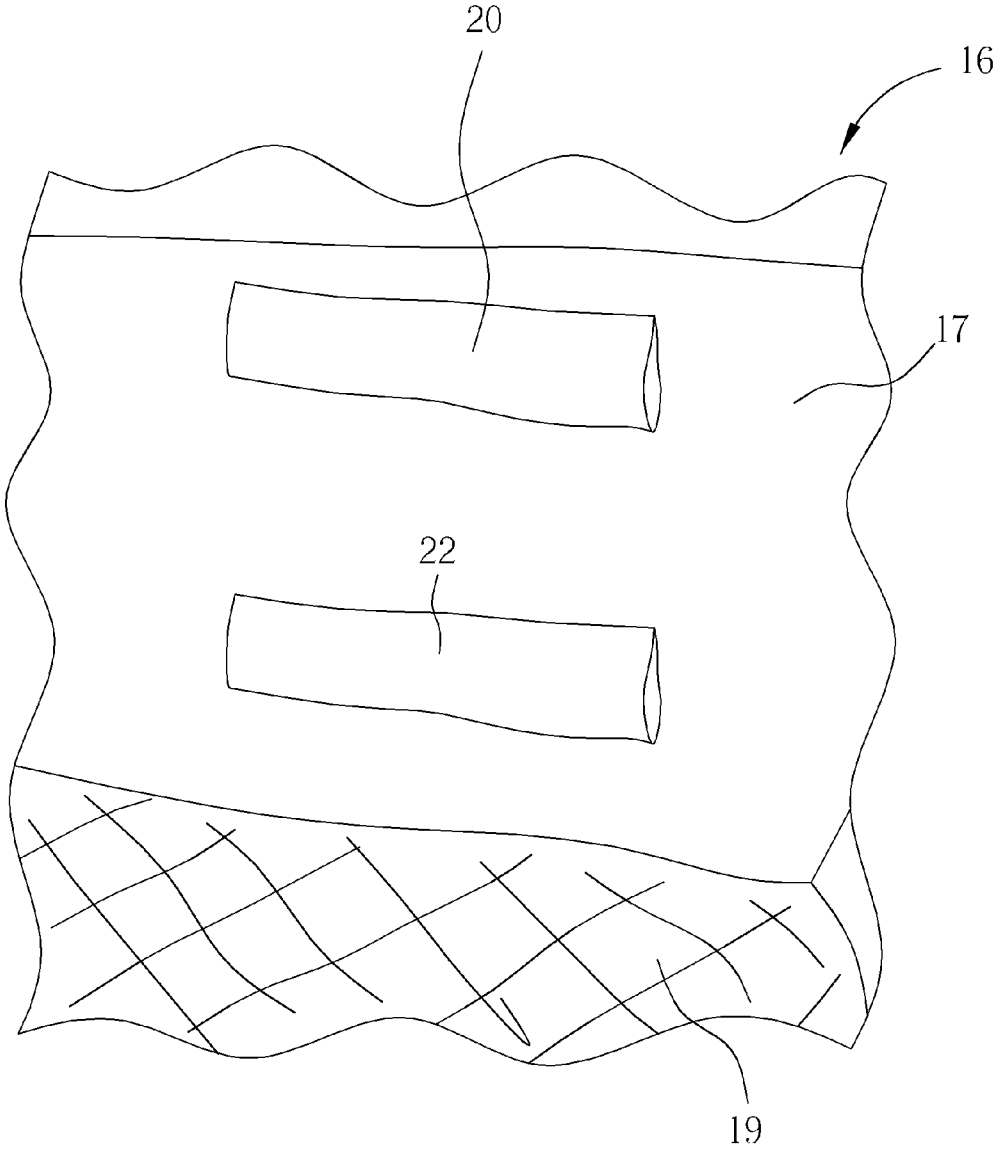
FIG. 2 is a partial diagram of a bassinet in FIG. 1.

Please refer to FIG. 1 and FIG. 2. FIG. 1 is a partial diagram of a playard module 10 according to an embodiment of the present invention. FIG. 2 is a partial diagram of a bassinet 16 in FIG. 1. As shown in FIG. 1 and FIG. 2, the playard module 10 includes a playard 12 and a bassinet set 14. The bassinet set 14 is hung on the playard 12. The bassinet set 14 includes the bassinet 16 and a placing device 18. The bassinet 16 has at least one first angle adjusting sleeve 20 (one shown in FIG. 1) and a second angle adjusting sleeve 22. The first angle adjusting sleeve 20 is formed on an inner wall 17 of the bassinet 16, and the height of the first angle adjusting sleeve 20 relative to a holding surface 19 of the bassinet 16 is greater than that of the placing device 18 when being disposed on the holding surface 19 of the bassinet 16. The second angle adjusting sleeve 22 is formed under the first angle adjusting sleeve 20, and the height of the second angle adjusting sleeve 20 relative to the holding surface 19 of the bassinet 16 is substantially equal to that of the placing device 18 when being placed on the holding surface 19 of the bassinet 16. In this embodiment, the placing device 18 is preferably an infant napper for allowing a caregiver to place an infant thereon. The structural design of the placing device 18 is described in detail as follows.

As shown in FIG. 1 and FIG. 2, the placing device 18 includes a holding body 24 and a tubular frame 26. The holding body 24 is used for holding an infant. The tubular frame 26 is disposed around the holding body 24 and includes a first end portion 28 and a second end portion 30. The second end portion 30 is used for detachably connecting to the first end portion 28 after the first end portion 28 passes through the first angle adjusting sleeve 20 or the second angle adjusting sleeve 22, so as to make the holding body 24 oblique to or substantially parallel to the bassinet 16.

Figure 3:
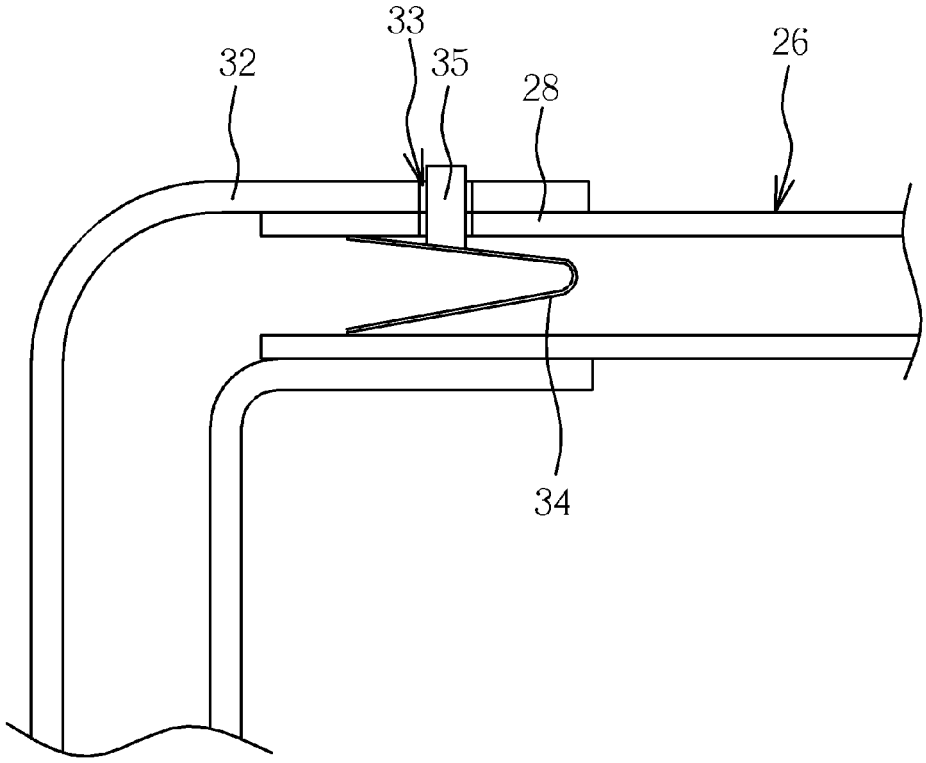
FIG. 3 is a partial internal diagram of a tubular frame in FIG. 1.

As for the detachable connection design between the first end portion 28 and the second end portion 30, it is depicted as shown in FIG. 3, which is a partial internal diagram of the tubular frame 26 in FIG. 1. As shown in FIG. 3, the tubular frame 26 further includes a tubular connecting member 32 and a V-shaped elastic sheet 34. The tubular connecting member 32 is connected to the second end portion 30 and having a fixing hole 33. The V-shaped elastic sheet 34 is disposed in the first end portion 28, and has a fixing bump 35 elastically protruding from the first end portion 28. The fixing bump 35 is used for engaging with the fixing hole 33 of the tubular connecting member 32 when the tubular connecting member 32 sleeves the first end portion 28, so as to fix the first end portion 28 to the second end portion 30. To be noted, the detachable connection design between the first end portion 28 and the second end portion 30 is not limited to FIG. 3. That is to say, all other connection designs having the same detachable effect, such as utilizing the first end portion 28 to be tightly fit in the second end portion 28, may fall within the scope of the present invention.

Figure 4:
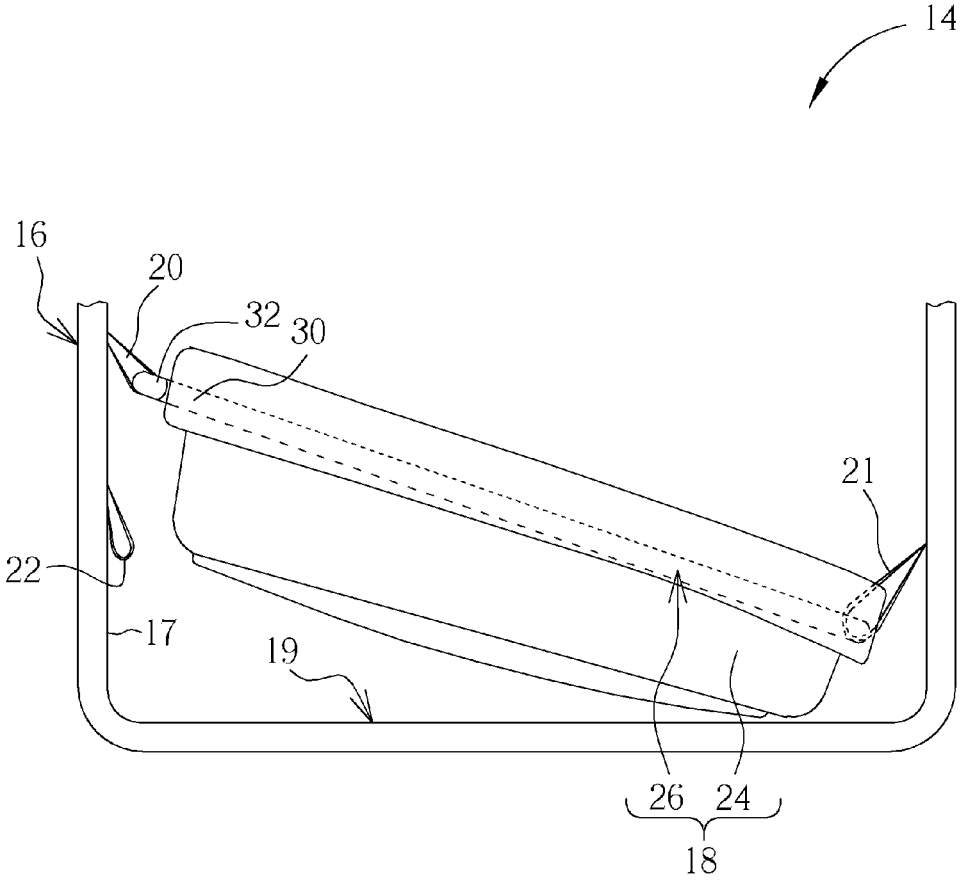
FIG. 4 is a side view of a placing device in FIG. 1 being fixing onto a first angle adjusting sleeve to be oblique to the bassinet.

More detailed description for angle adjustment of the bassinet set 14 is provided as follows. Please refer to FIG. 1, FIG. 3, and FIG. 4. FIG. 4 is a side view of the placing device 18 in FIG. 1 being fixed onto the first angle adjusting sleeve 20 to be oblique to the bassinet 16. When a caregiver wants to feed an infant lying flat on the placing device 18 which is substantially parallel to the bassinet 16 as shown in FIG. 1, the caregiver just needs to press the fixing bump 35 downward to be separate from the fixing hole 33, so as to release engagement of the tubular connecting member 32 and the first end portion 28. Subsequently, the caregiver can pull the first end portion 28 out of the second angle adjusting sleeve 22 in FIG. 1 since the first end portion 28 is no longer engaged with the tubular connecting member 32, and then utilize the first end portion 28 to pass through the first angle adjusting sleeve 20 instead. When the first end portion 28 has passed through the first angle adjusting sleeve 20, the caregiver can utilize the tubular connecting member 32 on the second end portion 30 to sleeve the first end portion 28 until the fixing bump 35 of the V-shaped elastic sheet 34 is engaged with the fixing hole 33 of the tubular connecting member 32 again. In such a manner, the placing device 18 can be fixed onto the first angle adjusting sleeve 20 as shown in FIG. 4. Thus, the infant can recline on the placing device 18 since the holding body 24 is oblique to the bassinet 16, so as to prevent the infant from acid reflux and choking when the caregiver feeds the infant on the placing device 18.

On the other hand, when the caregiver wants the infant to lie flat on the placing device 18, the caregiver just needs to press the fixing bump 35 downward to be separate from the fixing hole 33 and then pull the first end portion 28 out of the first angle adjusting sleeve 20 in FIG. 4. Subsequently, the caregiver can utilize the first end portion 28 to pass through the second angle adjusting sleeve 22 instead. Similarly, when the first end portion 28 has passed through the second angle adjusting sleeve 22, the caregiver can utilize the tubular connecting member 32 on the second end portion 30 to sleeve the first end portion 28 until the fixing bump 35 of the V-shaped elastic sheet 34 is engaged with the fixing hole 33 of the tubular connecting member 32 again. In such a manner, the placing device 18 can be fixed onto the second angle adjusting sleeve 22 as shown in FIG. 1, so that the placing device 18 can be disposed parallel to the bassinet 16 steadily. Thus, the infant can lie flat on the placing device 18, so as to make the infant feel more comfortable no matter the infant is awake or sleeping.

It should be mentioned that the said design that the first and second end portions of the tubular frame are detachably interconnected after the first end portion passes through the angle adjusting sleeve can be also applied to the opposite side of the placing device 18 in FIG. 1. Accordingly, the placing device 18 can be disposed on the bassinet 16 more steadily since the two sides of the placing device 18 can be fixed onto the bassinet 16 simultaneously. For example, the related configuration can be as shown in FIG. 4, in which the bassinet 16 can further has another angle adjusting sleeve 21 for fixing the tubular frame 26. As for the related description for the structural design at the opposite side of the placing device 18, it can be reasoned by analogy according to the said embodiment, and therefore be omitted herein.

The said second angle adjusting sleeve 22 is an omissible component for simplifying the design and angle adjusting operation of the bassinet set 14, meaning that the caregiver can just put the placing device 18 on the bassinet 16 directly without fixing the placing device 18 onto the bassinet 16 via the second angle adjusting sleeves 22. Furthermore, number of the first angle adjusting sleeve 20 is not limited to one as shown in FIG. 1. That is to say, there can be more than one first angle adjusting sleeve 20 to be formed on the inner wall 17 of the bassinet 16 for fixing the placing device 18 onto the bassinet 16 at different reclining angles, so as to increase flexibility of the bassinet set 14 in angle adjustment.

The said design can be also applied to the playard 12 for directly fixing the placing device 18 onto the playard 12 to make the holding body 24 oblique to or parallel to the playard 12 without the bassinet 16. For example, the playard 12 can has a third angle adjusting sleeve formed on an inner wall of the playard 12 and a fourth angle adjusting sleeve formed under the third angle adjusting sleeve (not shown in figures). Accordingly, when the first end portion 28 passes through the third angle adjusting sleeve, the second end portion 30 can be detachably connected to the first end portion to make the holding body 24 oblique to the playard 12, and when the first end portion 28 passes through the fourth angle adjusting sleeve, the second end portion 30 can be detachably connected to the first end portion 28 to make the holding body 24 substantially parallel to the playard 12. Furthermore, the said design can be further applied to a playard module only including a playard and a placing device. For example, the playard can has a first angle adjusting sleeve formed on an inner wall of the playard and a second angle adjusting sleeve formed under the first angle adjusting sleeve (not shown in figures) for fixing the placing device onto the playard to make the placing device oblique to or parallel to the playard. As for the related description for the structural design and angle adjustment of the said playard module, it can be reasoned by analogy according to the said embodiment and therefore omitted herein.

Compared with the prior art, the present invention utilizes the design that the first and second end portions of the tubular frame are detachably interconnected after the first end portion passes through the angle adjusting sleeve, to make the placing device oblique to the bassinet. In such a manner, via the said simple design, the present invention cannot only provide an angle adjusting function to the placing device without additional disposal of an angle adjusting mechanism with a complicated design, but also solve the said infant acid reflux and choking problem.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A bassinet set for hanging on a playard, the bassinet set comprising:

a bassinet having at least one first angle adjusting sleeve formed on an inner wall of the bassinet; and a placing device removably disposed on the bassinet, the placing device comprising:

a holding body for holding an infant; and a tubular frame disposed around the holding body, the tubular frame comprising:

a first end portion; and a second end portion for detachably connecting to the first end portion after the first end portion passes through the first angle adjusting sleeve, so as to make the holding body abut against a bottom of the bassinet and connect to the inner wall of the bassinet to be oblique to the bassinet.

2. The bassinet set of claim 1, wherein the height of the first angle adjusting sleeve relative to a holding surface of the bassinet is greater than that of the placing device when being disposed on the holding surface of the bassinet.

3. The bassinet set of claim 1, wherein the bassinet further has a second angle adjusting sleeve formed under the first angle adjusting sleeve, and the second end portion is further used for detachably connecting to the first end portion after the first end portion passes through the second angle adjusting sleeve, so as to make the holding body substantially parallel to the bassinet.

4. The bassinet set of claim 3, wherein the height of the second angle adjusting sleeve relative to a holding surface of the bassinet is substantially equal to that of the placing device when being disposed on the holding surface of the bassinet.

5. The bassinet set of claim 1, wherein the tubular frame further comprises:

a tubular connecting member connected to the second end portion and having a fixing hole; and a V-shaped elastic sheet disposed in the first end portion and having a fixing bump elastically protruding from the first end portion, the fixing bump being used for engaging with the fixing hole when the tubular connecting member sleeves the first end portion, so as to fix the first end portion to the second end portion.

6. The bassinet set of claim 1, wherein the placing device is an infant napper.

7. A playard module comprising:

a playard; and a bassinet set hung on the playard, the bassinet set comprising:

a bassinet having at least one first angle adjusting sleeve formed on an inner wall of the bassinet; and a placing device removably disposed on the bassinet, the placing device comprising:

a holding body for holding an infant; and a tubular frame disposed around the holding body, the tubular frame comprising:

a first end portion; and a second end portion for detachably connecting to the first end portion after the first end portion passes through the first angle adjusting sleeve, so as to make the holding body abut against a bottom of the bassinet and connect to the inner wall of the bassinet to be oblique to the bassinet.

8. The playard module of claim 7, wherein the height of the first angle adjusting sleeve relative to a holding surface of the bassinet is greater than that of the placing device when being disposed on the holding surface of the bassinet.

9. The playard module of claim 7, wherein the bassinet further has a second angle adjusting sleeve formed under the first angle adjusting sleeve, and the second end portion is further used for detachably connecting to the first end portion after the first end portion passes through the second angle adjusting sleeve, so as to make the holding body substantially parallel to the bassinet.

10. The playard module of claim 9, wherein the height of the second angle adjusting sleeve relative to a holding surface of the bassinet is substantially equal to that of the placing device when being disposed on the holding surface of the bassinet.

11. The playard module of claim 7, wherein the tubular frame further comprises:

a tubular connecting member connected to the second end portion and having a fixing hole; and a V-shaped elastic sheet disposed in the first end portion, and having a fixing bump elastically protruding from the first end portion, the fixing bump being used for engaging with the fixing hole when the tubular connecting member sleeves the first end portion, so as to fix the first end portion to the second end portion.

12. The playard module of claim 7, wherein the placing device is an infant napper.

13. The playard module of claim 7, wherein the playard has at least one third angle adjusting sleeve formed on an inner wall of the playard, and when the first end portion passes through the third angle adjusting sleeve, the second end portion is further used for detachably connecting to the first end portion to make the holding body oblique to the playard.

14. The playard module of claim 13, wherein the playard further has a fourth angle adjusting sleeve formed under the third angle adjusting sleeve, and when the first end portion passes through the fourth angle adjusting sleeve, the second end portion is further used for detachably connecting to the first end portion to make the holding body substantially parallel to the playard.

15. A playard module comprising:

a playard having at least one first angle adjusting sleeve formed on an inner wall of the playard; and a placing device removably disposed on the playard, the placing device comprising:

a holding body for holding an infant; and a tubular frame disposed around the holding body, the tubular frame comprising:

a first end portion; and a second end portion for detachably connecting to the first end portion after the first end portion passes through the first angle adjusting sleeve, so as to make the placing device abut against a bottom of the playard and connect to the inner wall of the playard to be oblique to the playard.

16. The playard module of claim 15, wherein the height of the first angle adjusting sleeve relative to a holding surface of the playard is greater than that of the placing device when being disposed on the playard.

17. The playard module of claim 15, wherein the playard further has a second angle adjusting sleeve formed under the first angle adjusting sleeve, and the second end portion is further used for detachably connecting to the first end portion after the first end portion passes through the second angle adjusting sleeve, so as to make the holding body substantially parallel to the playard.

18. The playard module of claim 17, wherein the height of the second angle adjusting sleeve relative to a holding surface of the playard is substantially equal to that of the placing device when being disposed on the holding surface of the playard.

19. The playard module of claim 15, wherein the tubular frame further comprises:

a tubular connecting member connected to the second end portion and having a fixing hole; and a V-shaped elastic sheet disposed in the first end portion and having a fixing bump elastically protruding from the first end portion, the fixing bump being used for engaging with the fixing hole when the tubular connecting member sleeves the first end portion, so as to fix the first end portion to the second end portion.

20. The playard module of claim 15, wherein the placing device is an infant napper.

* * * * *